United States Patent [19]

Ellington, III

[11] Patent Number: 4,833,841

[45] Date of Patent: May 30, 1989

[54] TRANSPORTABLE BUILDING MODULE

[75] Inventor: Joseph C. Ellington, III, Raleigh, N.C.

[73] Assignee: Systems Craft, Durham, N.C.

[21] Appl. No.: 133,638

[22] Filed: Dec. 16, 1987

[51] Int. Cl.[4] ..... E06B 1/04

[52] U.S. Cl. ..... 52/79.1; 52/143; 52/289; 52/690

[58] Field of Search ..... 52/79.1–79.5, 52/79.7, 79.8, 79.9, 234, 694, 210, 289, 143, 690

[56] References Cited

U.S. PATENT DOCUMENTS

| | | | |
|---|---|---|---|
| 3,225,434 | 12/1965 | van der Lely et al. . | |
| 3,256,652 | 6/1966 | van der Lely . | |
| 3,605,350 | 9/1971 | Bowers | 52/79.7 |
| 3,792,558 | 2/1974 | Berce et al. . | |
| 4,040,227 | 8/1977 | van der Lely et al. . | |
| 4,045,937 | 9/1977 | Stucky . | |
| 4,077,170 | 3/1978 | van der Lely . | |
| 4,106,243 | 8/1978 | Horn | 52/79.1 X |
| 4,439,957 | 4/1984 | Raasakka et al. | 52/79.1 |
| 4,545,159 | 10/1985 | Rizk . | |
| 4,599,829 | 7/1986 | DiMartino, Sr. . | |
| 4,638,607 | 1/1987 | Hadjiiski et al. . | |
| 4,644,708 | 2/1987 | Baudot et al. . | |

FOREIGN PATENT DOCUMENTS 1434002 2/1968 Fed. Rep. of Germany ..... 52/79.1

OTHER PUBLICATIONS

Sheffield Steel Corp., Sheffield Steel Jotst Product Catalog No. 452, 1953, p. 5.

*Primary Examiner*—David A. Scherbel
*Assistant Examiner*—Richard E. Chilcot, Jr.
*Attorney, Agent, or Firm*—Richard E. Jenkins

[57] ABSTRACT

A prefabricated transportable building module comprising a metal floor frame having a reinforced concrete floor provided within the perimeter thereof, four upstanding vertical posts secured at each corner of the floor structure and a roof structure including a transverse beam extending between and secured to the pair of vertical columns at each end of the building module and further including a plurality of spaced-apart and parallel open web trusses extending between and secured at each end thereof to the pair of transverse beams.

24 Claims, 4 Drawing Sheets

TRANSPORTABLE BUILDING MODULE

DESCRIPTION

1. Technical Field

The present invention relates to a prefabricated and transportable building module of the type characterized by a clear span, support frame and concrete floor and which is adapted to stand alone or to be placed in side-by-side and/or vertically stacked relationship with other modules for forming a complete building when said module is transported to a building site.

2. Background Art

Transportable building modules which are assembled in a factory and then transported to a building site to produce a structure of a desired size are well known in the construction art. More specifically, transportable building modules utilizing a steel frame and having a concrete floor in order to provide a built-on-site feel to a unit constructed therefrom are presently known. However, it is applicant's belief that all of the transportable building modules known to date suffer from shortcomings which have now been overcome by applicant's novel module construction. For example, concrete floor modules are known which utilize C beams around the roof structure perimeter and transversely extending roof purlins to stabilize the perimeter frame. When this type of module is constructed with a length exceeding about 30 feet and with a width exceeding about 8 to 10 feet the module many times requires additional vertical support beams to prevent the roof from sagging in the medial portion thereof due to the weight of the side members of the roof perimeter frame which extend between vertical corner posts on each side of the module. If a clear span module is required, conventional transportable building modules utilizing this type of construction require that the longitudinally extending side beams in the roof structure be of a very large size in order to support the roof without sagging.

An alternative construction known in the trade utilizes a roof construction comprising a bar joist on each side of the roof in the lengthwise direction wherein each bar joist is supported at each end thereof by a vertical corner post. A plurality of spaced-apart transverse wood purlins extend between the bar joists. This, of course, is not ideal since the support frame of the building module is not as strong as a unitized support frame and may not meet fire codes in view of the use of wood in the support frame.

As can be appreciated, these particular types of transportable building module support frame constructions all suffer from significant shortcomings with respect to strength and/or the ability to be freely transported on a highway to the building site without potential damage to the building module. As is understood by those familiar with the transportable building module art, once the modules actually arrive at the building site they are usually set up on a foundation within about one day and require up to several weeks in which to complete the interior and exterior upfitting of the unit for its particular intended end use. Typically, the exterior and interior walls, ceiling, plumbing, electrical and duct work are installed at the factory prior to transportation of the building module to the permanent site for completion.

Summarily, the transportable building modules presently known to applicant all utilize roof structures which suffer shortcomings with respect to weight structural integrity and/or meeting local fire codes. Applicant's transportable building module utilizes a novel roof construction which provides for a clear span, unitized support frame of high strength that is unexpectedly and surprisingly lightweight. Moreover, and also very importantly, the novel roof structure allows for a relatively high ceiling when the building modules are completed since heating and air conditioning ducts, electrical and plumbing conduits and the like may be threaded horizontally therethrough as opposed to having to be dropped under the large side beams utilized in many conventional transportable building modules known to date. Also, applicant's all steel roof structure is noncombustible so as to meet all applicable local fire codes.

DISCLOSURE OF THE INVENTION

In accordance with the present invention, a prefabricated transportable building module is provided which utilizes an improved roof structure of high strength and low relative weight and which lends itself to a high ceiling in the completed building structure. The transportable building module comprises a floor structure having two spaced-apart and parallel side strength members joined together by two spaced-apart and parallel end strength members with a plurality of transverse beams or purlins extending between the two side strength members. A concrete floor is provided within the space defined by the perimeter of the floor structure, and an upstanding vertical column is provided at each corner of the floor structure so as to form four corner posts for supporting a roof structure. The roof structure of the invention comprises a transverse beam extending between the pair of vertical columns at each end of the elongated building module and a plurality of spaced-apart bar joists extending between and secured to the transverse beams of the building module.

In a preferred embodiment of the invention, the roof structure comprises four spaced-apart bar joists extending in the lengthwise direction of the building module and secured at each end to a respective one of the pair of transverse beams extending between the corner posts at opposing ends of the module. In another embodiment of the invention, the outermost bar joists on each side of the module are secured to the upright corner posts and one or more spaced-apart bar joists positioned therebetween are secured to the aforementioned transverse beams extending across each end face of the building module.

It is therefore an object of the present invention to provide an improved transportable prefabricated building module.

Another object of the present invention is to provide an improved transportable building module which can be prefabricated in a factory and transported to a building site without damage to the module due to its high strength and relatively low weight roof structure.

Yet another object of the present invention is to provide a transportable building module which has a relatively high strength-to-weight ratio roof structure so as to significantly reduce both the roof structure weight as well as the total module weight to facilitate transport of the building module to a building site.

Still further, another object of the present invention is to provide a transportable building module which lends itself to a relatively higher internal ceiling when completed than conventional transportable building modules of similar height.

Still further, another object of the present invention is to provide a transportable building module which is particularly well adapted for being placed in side-by-side and/or vertically stacked relationship with additional building modules and extending all necessary duct work and conduits through the roof structure.

Still further, another object of the present invention is to provide an improved transportable building module of the type having a reinforced concrete floor which possesses a strong and lightweight roof structure so as not to be top heavy and inherently unstable during mobile transportation around corners.

Some of the objects of the invention having been stated, other objects will become evident as the description proceeds, when taken in connection with the accompanying drawings.

BEST MODE FOR CARRYING OUT THE INVENTION

While the present invention will be described hereinafter with particular reference to the accompanying drawings, in which a certain embodiment of the present invention is shown, it is to be understood at the outset of the description which follows that it is contemplated that a structure in accordance with the present invention may be varied from the specific form described hereinafter, while still obtaining the desired result of this invention. Accordingly, the description which follows is to be understood as a broad teaching disclosure directed to persons of appropriate skill in the appropriate arts, and not as limiting upon the scope of this invention.

Figure 1:
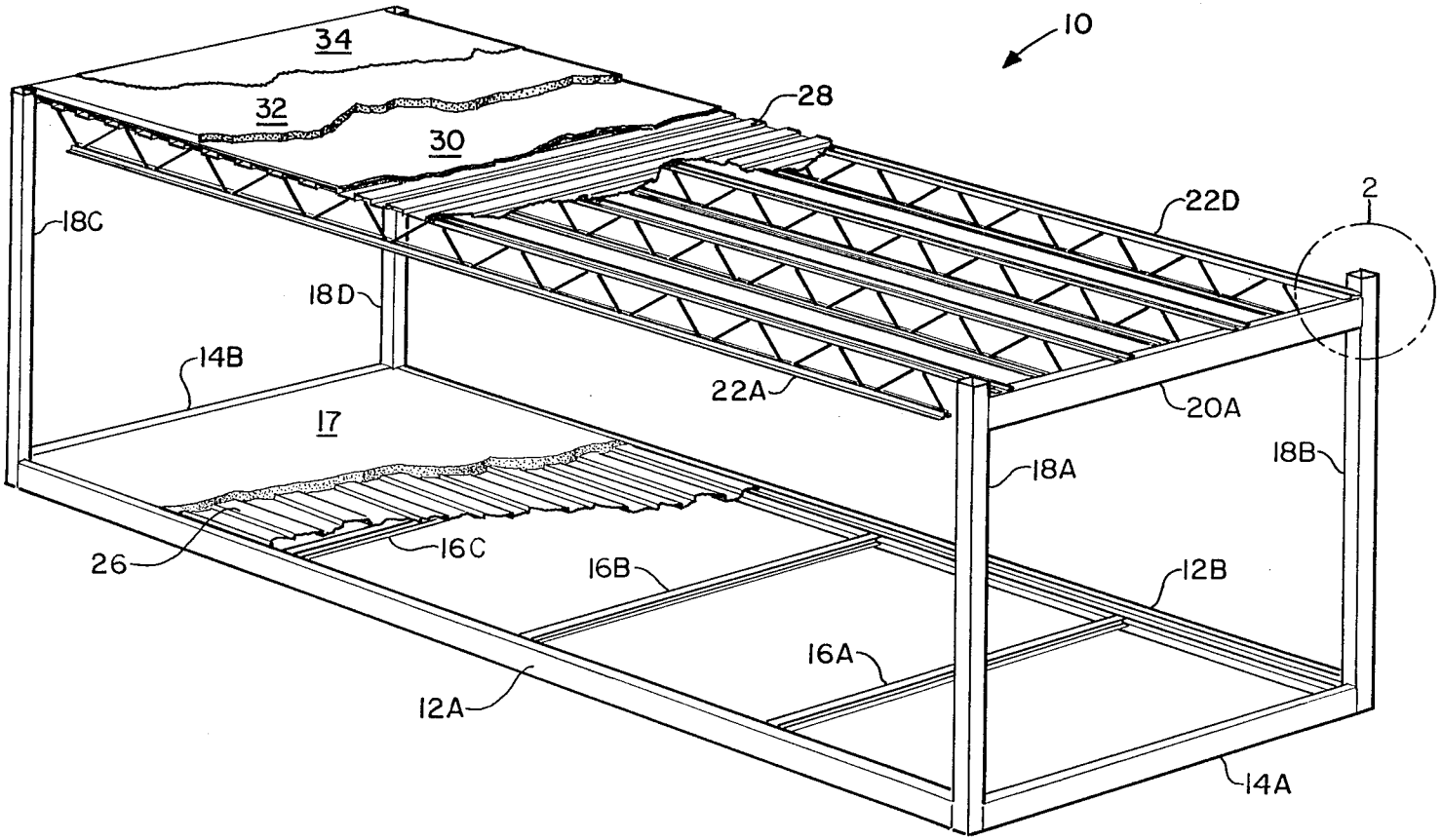
FIG. 1 is a perspective view of a transportable building module according to the present invention with parts broken away for clarity.
Figure 2:
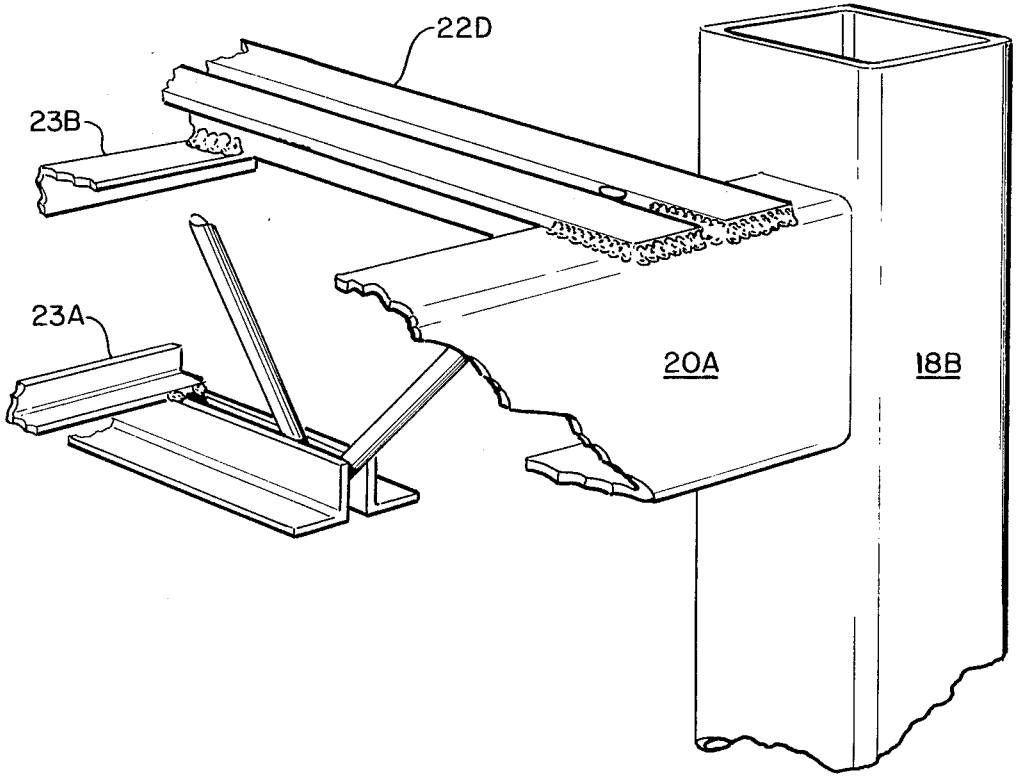
FIG. 2 is an enlarged fragmentary perspective view of a corner of the roof structure of a building module according to the present invention.
Figure 3:
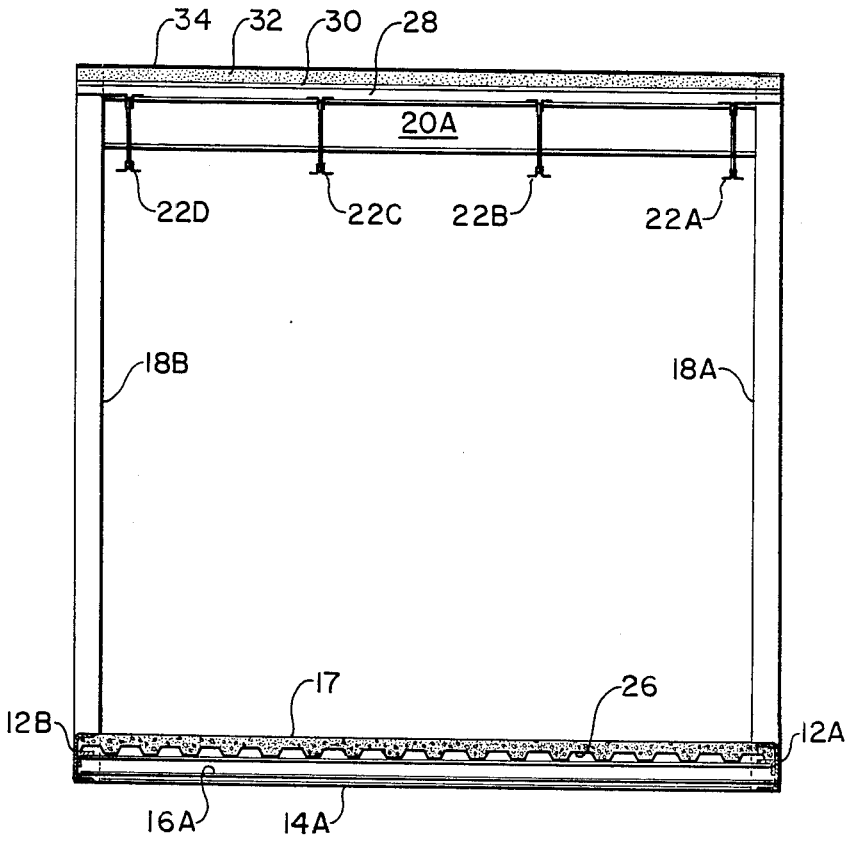
FIG. 3 is a vertical cross sectional view of a building module according to the present invention taken on line 3—3 of FIG. 4.
Figure 4:
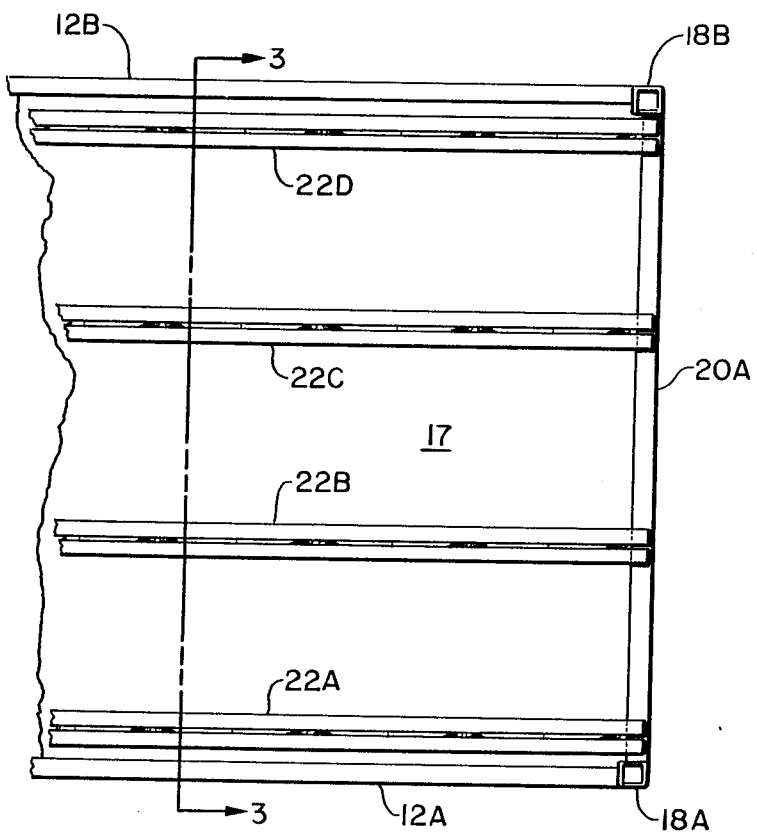
FIG. 4 is a top plan view of the roof support frame of a building module according to the present invention.
Figure 4:
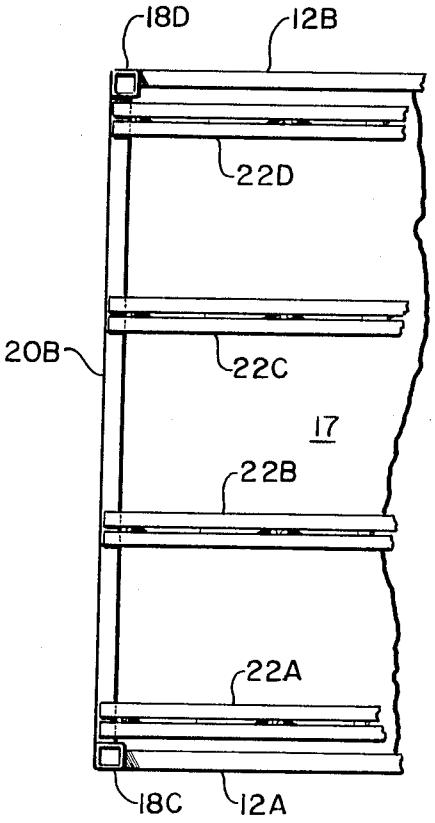

Referring now more specifically to the drawings, a preferred embodiment of a transportable building module according to the present invention is shown in FIGS. 1 to 4 and generally designated 10. Building module 10 has a load-bearing and unitized support frame of novel construction which utilizes a floor structure comprising side strength members 12A, 12B which are joined together at each end by end strength members 14A, 14B. For additional support, internal strength members 16A–16C are provided which extend transversely across the floor structure and are secured at each end thereof to side strength members 12A, 12B. The floor structure of module 10 supports a reinforced concrete slab 17 as seen in FIGS. 1 and 3 and described in more detail below.

Vertical columns 18A–18D are secured at each corner of the floor structure so as to provide four loading-bearing corner posts for the roof. The novel roof structure of the module of the invention comprises transverse beams 20A, 20B extending across the top of each end face of building module 10. Each of transverse beams 20A, 20B is secured to a respective pair of vertical columns at the opposing end faces of building module 10. Specifically, transverse beam 20A is secured to vertical columns 18A and 18B and transverse beam 20B is secured to vertical columns 18C and 18D. Extending in spaced-apart and parallel relationship between transverse beams 20A, 20B are fur open web trusses or bar joists 22A–22D. Bar joists 22A–22D are secured at each end thereof to transverse beams 20A, 20B and, most suitably, outside bar joists 22A, 22D are spaced-apart about 2 inches from vertical columns 18A, 18C and 18B, 18D, respectively. As can best be understood with reference to FIG. 2, bar joists 22A–22D are also secured to each other for better integrity by five pairs of bridging elements which extend transversely through all four bar joists 22A–22D and are secured along the length of bar joists 22A–22D in pairs wherein each pair is positioned at the upper and lower portion of a corresponding open space along the length of the bar joists (see bridging elements 23A, 23B in FIG. 2). The bridging elements are not shown in FIGS. 1, 3 and 4 for purposes of clarity of illustration of building module 10.

The novel roof structure described hereinabove is a high strength and low weight structure which makes possible the assembly of a clear span building module 10 having a length of about 12 to 60 feet which does not require any additional vertical support at the medial portion of the sides thereof. The width of such a module would typically be about 8 to 16 feet. In addition to not requiring additional vertical columns in the lengthwise direction to support the novel roof structure, its relatively low weight provides for ease of transportation from the assembly plant to the location site. A more conventional all steel clear span roof structure as used on other transportable building modules tends to be top heavy and presents many difficulties including a tendency for the building module to tip over during transportation around corners as well as providing greater stress to the module which can result in damage thereto during transportation.

Applicant has found that the novel roof structure of the building module weighs only about one-half of what a conventional all steel roof structure of similar strength would weigh. Whereas applicant primarily utilizes bar joists for strength, the support frames of conventional unitized frame building modules typically utilize a C beam perimeter having a plurality of purlins extending transversely to the lengthwise direction of the roof structure. The difference in weight is surprisingly significant as can be appreciated with reference to Table 1 below. Table 1 represents the structural elements and weight thereof for a roof structure suitable for a 12 foot wide and 44 foot long clear span building module which is capable of supporting a live load of 40 pounds per square inch.

TABLE 1

| PRIOR ART ROOF STRUCTURE FOR BUILDING MODULE |
|---|
| 10 C6 × 8.2 PURLINS |
| 2 W18 × 35 PURLINS |
| 2 C10 × 15.3 PURLINS |
| TOTAL WEIGHT OF ROOF STRUCTURE 4,390 POUNDS |
| APPLICANT'S NOVEL LIGHTWEIGHT ROOF STRUCTURE FOR BUILDING MODULE |
| 4 22H6 BAR JOISTS |
| 2 C10 × 15.3 PURLINS |
| 10 1 × 1 × ⅛ INCH BRIDGING ELEMENTS |
| TOTAL WEIGHT OF ROOF STRUCTURE 2,170 POUNDS |

To summarize the advantages of applicant's roof structure, it should be appreciated that the bar joist roof system eliminates the need for horizontal purlins as well as a perimeter frame of purlins or beams and thus results in a substantial weight reduction while still maintaining necessary requirements for roof load support strength. Also, applicant's lightweight roof renders transportation of the building module much safer and easier as well as significantly reducing the dead weight of the entire transportable building module. Moreover, the bar joist system allows for greater ceiling height than conventional roof structures known to date in either a singular unit construction or multiple side-by-side building module configuration since the air conditioning and heating ducts, electrical conduits, and plumbing can be threaded through the open web trusses as opposed to conventional roof structures which require that the aforementioned elements be dropped below the large side strength members of the roof structure. Finally, it should also again be emphasized that a building module having a typical size of 12 feet in width and 44 feet in length would normally either require vertical post supports in the middle of the longitudinally extending side beams of the roof structure or the use of very heavy and expensive side beams capable of spanning the 44 foot length between vertical columns without requiring a central support member to prevent sagging.

Applicant would now like to provide a more detailed description of the support frame of the building module of the invention in order to provide even greater specificity of explanation of the instant invention to one skilled in the transportable building module construction art.

A typical 12 foot wide and 44 foot long building module contemplated by the invention comprises a floor structure having a perimeter formed of C10×15.3 steel side strength members 12A, 12B and end strength members 14A, 14B. W6×20 flange purlins 16A–16C are welded transversly within the perimeter. Corrugated decking 26 (see FIG. 1) is welded to side strength members 12A, 12B and end strength members 14A, 14B and transverse purlins 16A–16C. Corrugated decking 26 is most suitably a 2 inch 20 gauge galvanized composite steel deck as known to those familiar with the art. Reinforced cement slab 17 is provided over corrugated decking 26 at a thickness of 2½ inches at the top of the corrugation flutes and 4½ inches at the bottom of the flutes (see FIG. 3). The concrete utilized for reinforced concrete flooring 17 is 4,000 p.s.i. reinforced concrete with 1.5 pounds per cubic yard fiber mesh which is screeded flush with ½ inch thick temporary screeds (not shown) affixed to the perimeter of the support frame.

Vertical columns 18A–18D comprise 3½×3½×3/16 inch hot rolled tubular steel. Transverse beams 20A, 20B of the roof structure of building module 10 most suitably comprise hot rolled C10×15.3 steel beams welded to vertical columns 18A–18D. Bar joists 22A–22D comprise 4 22H6 bar joists welded at each end to transverse beams 20A, 20B and having a maximum spacing therebetween of 48 inches (see FIG. 4). The five pairs of bridging elements (one pair 23A, 23B shown in FIG. 2) utilized to enhance structural integrity of bar joists 22A–22D are most suitably 1 inch by 1 inch by ⅛ inch angle iron welded to the top and bottom of the open trusses in 5 pairs at five lengthwise spaced-apart locations. Although a matter of design choice, roof deck 28 is most suitably a 1½ inch 22 gauge Type B galvanized corrugated steel decking spanning bar joists 22A–22D. Corrugated decking 28 is welded to bar joists 22A–22D and gypsum board 30, rigid roof insulation 32, and single ply roof membrane 34 are mechanically attached to corrugated decking 28 (see FIGS. 1 and 3).

It will be appreciated by those familiar with the art that the materials utilized to complete the roof of building module 10 as described above as well as materials utilized to complete the external and internal wall assemblies, the internal ceiling and the general upfitting of module 10 are a matter of design choice. Most typically, the support frame of building module 10 will be completed at the assembly plant with decking 28 installed over bar joists 22A–22D and suitable roofing applied to the roof decking. The internal and external walls will be constructed with non-load bearing studs and suitable sheeting according to the end use demands of the module. Also, the necessary air conditioning and heating ducts as well as electrical wiring and plumbing conduits will be installed in the building module along with a desired finished ceiling typically comprising a suspended grid system for receiving lay-in acoustic boards. When the module has been completed on a factory assembly line to this level of finish, it is transported by mobile vehicle to an on-site location at which a foundation has been previously prepared so that the module may be positioned thereon and suitably anchored to the foundation. Normally the module can be installed at the on-site location on the day of delivery. The necessary interior upfittings are installed along with completion of the exterior of the module over a period of up to several weeks according to the intended use of a singular module or a plurality of the modules placed in abutting side-to-side and/or vertically stacked relationship in order to form a larger building than provided for by the typical 12 foot by 44 foot module.

In the drawings and specifications, there as been set forth a preferred embodiment of the invention, and although specific terms are employed, they are used in a generic and descriptive sense only and not for purposes of limitation.

What is claimed is:

1. In a transportable building module of the type characterized by a clear span, load bearing support frame comprising a floor structure having four corners and having two spaced-apart and parallel side strength members and two spaced-apart and parallel end strength members which are connected to and join together said side strength members, said side and end strength members defining a horizontal plane, and further including at least one internal strength member extending across said plane defined by said side and end strength members, an upstanding vertical column having a lower end and an upper end and secured adjacent the lower end thereof to each corner of said floor structure so as to form four corner posts, and a roof structure secured to said upstanding vertical columns adjacent the upper ends thereof, said building module further characterized by a reinforced concrete floor being provided within the space defined by said side and end strength members of said floor structure, said end strength members and said vertical columns defining two spaced-apart vertical end planes of said support frame, the improvement wherein a novel roof structure is provided for said building module comprising a transverse beam extending between and secured to the pair of vertical columns at each end of said support frame so that each of said transverse beams will lie substantially in a respective one of the two spaced-apart end planes of said support frame, and a plurality of spaced-apart and parallel open web trusses extending between and secured at each end to a perspective one of said pair of transverse beams.

2. A transportable building module according to claim 1 wherein said building module comprises a width between about 8 to 16 feet and a length between about 12 to 60 feet.

3. A transportable building module according to claim 2 wherein said building module comprises a width of about 12 feet and a length of about 44 feet.

4. A transportable building module according to claim 1 wherein said transverse beams each comprises a C beam.

5. A transportable building module according to claim 4 wherein said transverse beams are welded at each end thereof to said vertical columns.

6. A transportable building module according to claim 1 wherein said open web trusses comprise bar joists.

7. A transportable building module according to claim 6 wherein said bar joists are welded to said transverse beams.

8. A transportable building module according to claim 6 wherein said plurality of bar joists comprises four bar joists.

9. A transportable building module according to claim 6 including at least one bridging element extending across said plurality of bar joists and secured thereto.

10. A transportable building module according to claim 1 including an open web truss extending above and parallel to each of said two side strength members, said trusses extending between and secured to the pair of vertical columns on each side of said support frame so that each of said trusses will lie substantially in a respective one of the two spaced-apart side planes of said support frame.

11. A transportable building module according to claim 1 including non-load bearing external and internal walls, a roof secured above said plurality of open web trusses, and a ceiling secured beneath said plurality of open web trusses.

12. A transportable building module according to claim 11 including at least two of said building modules placed in side-to-side abutting relationship to provide a building unit larger than a singular building module.

13. A transportable building module having a load bearing frame comprising:

a floor structure having four corners and comprising two spaced-apart and parallel side strength members and two spaced-apart and parallel end strength members which are connected to and join together said side strength members, said side and end strength members defining a horizontal plane, and further including at least one internal strength member extending across said plane defined by said side and end strength members;

a concrete floor being provided within the space defined by said side and end strength members of said floor structure;

an upstanding vertical column having a lower end and an upper end and secured adjacent the lower end thereof to each corner of said floor structure so as to form four corner posts, said end strength members and said vertical columns defining two spaced-apart vertical end planes of said building module; and a roof structure comprising a transverse beam extending between and secured to the pair of vertical columns at each end of said building module so that each of said transverse beams will lie substantially in a respective one of the two spaced-apart end planes of said building module, and a plurality of spaced-apart and parallel open web trusses extending between and secured at each end to a respective one of said pair of transverse beams.

14. A transportable building module according to claim 13 wherein said building module comprises a width between about 8 to 16 feet and a length between about 12 to 60 feet.

15. A transportable building module according to claim 14 wherein said building module comprises a width of 12 feet and a length of about 44 feet.

16. A transportable building module according to claim 13 wherein said transverse beams each comprises a C beam.

17. A transportable building module according to claim 16 wherein said transverse beams are welded at each end thereof to said vertical columns.

18. A transportable building module according to claim 13 wherein said open web trusses comprise bar joists.

19. A transportable building module according to claim 18 wherein said bar joists are welded to said transverse beams.

20. A transportable building module according to claim 18 wherein said plurality of bar joists comprises four bar joists.

21. A transportable building module according to claim 18 including at least one bridging element extending across said plurality of bar joists and secured thereto.

22. A transportable building module according to claim 13 including an open web truss extending above and parallel to each of said two side strength members, said trusses extending between and secured to the pair of vertical columns on each side of said support frame so that each of said trusses will lie substantially in a respective one of the two spaced-apart side planes of said support frame.

23. A transportable building module according to claim 13 including non-load bearing external and internal walls, a roof secured above said plurality of open web trusses, and a ceiling secured beneath said plurality of open web trusses.

24. A transportable building module according to claim 13 including at least two of said building modules placed in side-to-side abutting relationship to provide a building unit larger than a singular building module.

* * * * *